US005298699A

United States Patent [19]

Ballentine et al.

[11] Patent Number: 5,298,699

[45] Date of Patent: Mar. 29, 1994

[54] ROTOR FOR AN IGNITION DISTRIBUTOR

[75] Inventors: Richard E. Ballentine; James A. Boyer, both of Anderson, Ind.

[73] Assignee: General Motors Corporation, Detorit, Mich.

[21] Appl. No.: 22,586

[22] Filed: Feb. 25, 1993

[51] Int. Cl.[5] ..... 200 19 R; H01R 39/00

[52] U.S. Cl. ..... 200/19 DR

[58] Field of Search ..... 200/19 R, 19 DR, 27 A, 200/30 A; 74/10, 10.22, 10.31; 123/146.5 R, 146.5 A

[56] References Cited

U.S. PATENT DOCUMENTS

| | | | |
|---|---|---|---|
| 1,939,807 | 12/1983 | Fibish | 200/19 R |
| 2,176,164 | 10/1939 | Arthur | 200/19 R |
| 2,187,070 | 1/1940 | Arthur | 200/31 |
| 2,828,374 | 3/1958 | Redick | 200/19 |
| 2,864,967 | 12/1958 | Redick et al. | 200/19 R |
| 3,124,666 | 3/1964 | O'Brien | 200/19 |

*Primary Examiner*—A. D. Pellinen
*Assistant Examiner*—Michael A. Friedhofer
*Attorney, Agent, or Firm*—Creighton R. Meland

[57] ABSTRACT

An ignition distributor rotor that is formed of electrical insulating material. The rotor has a retainer portion that is adapted to be pressed onto the end of a distributor drive shaft. This retainer portion has an axially extending wall that has an undulated shape defined by circumferentially spaced undulated portions. The inner surfaces between the undulated portions tightly engage outer surface portions of the shaft. One of the undulated portions is located in a slot in the shaft to form a driving connection between the shaft and the rotor. The retainer portion has a plurality of flexible circumferentially spaced latch arms. The ends of the latch arms are shaped to enter an annular groove on the distributor shaft to thereby lock the rotor from a axial movement relative to the distributor shaft.

9 Claims, 1 Drawing Sheet

ROTOR FOR AN IGNITION DISTRIBUTOR

This invention relates to a rotor for an ignition distributor and to a means for securing the rotor to the shaft of an ignition distributor.

The rotor of an ignition distributor transfers high voltage from the center electrode of a distributor cap to the outer circumferentially spaced cap inserts that are connected to the spark plugs of an internal combustion engine. The rotor is secured to and driven by the ignition distributor drive shaft and a secure connection must be made between the rotor and the drive shaft Thus, the rotor position is critical for correct firing of the spark plugs. If the rotor works loose from the shaft, spark scatter and crossfiring to an incorrect spark plug can occur. If the rotor vibrates up the shaft, scraping between the distributor cap and the rotor can cause premature failure.

It is an object of this invention to provide a secure connection between the rotor and drive shaft of an ignition distributor that does not require fasteners such as screws and does not require fasteners such as metal spring clips. In carrying this object forward, the distributor shaft is provided with an annular groove and with an axially extending slot. The rotor is formed of a molded plastic material. The rotor has a plurality of flexible latch arms the ends of which having latching teeth. When the rotor is pushed onto the end of the shaft, the latch arms are deflected outwardly and when the rotor has been moved to its final assembled position, the latch arm teeth move inwardly into the annular groove on the shaft to lock the rotor from axial movement relative to the shaft. The rotor further has a wall that has an undulated configuration that is defined by circumferentially spaced undulated portions. One of the undulated portions forms a rib that slides into the axial extending slot on the shaft when the rotor is assembled to the shaft to thereby lock the rotor from rotation relative to the shaft and to form a driving connection between the shaft and the rotor. The undulated wall has circumferentially spaced areas that tightly engage the shaft. The undulated wall may be termed a spring wall since it is displaced radially outwardly and develops a spring-like force when the rotor is assembled to the shaft to tightly grip the shaft.

Figure 1:
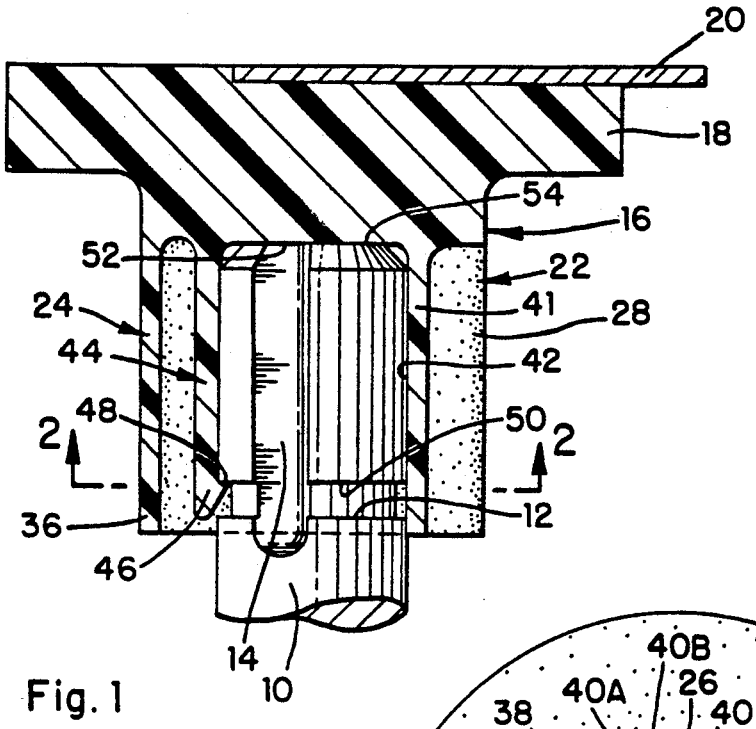
FIG. 1 is a sectional view of an ignition distributor rotor connected to an ignition distributor drive shaft.

Referring now to the drawings, the reference numeral 10 designates a metallic drive shaft of an ignition distributor. The shaft 10 has an annular groove 12 and an axially and radially extending slot 14.

A rotor generally designated as 16 is shown connected to distributor drive shaft 10. The rotor 16 has a rotor contact supporting portion 18 that carries a metallic rotor contact 20. The rotor 16 further has a lower retaining portion 22 that is used to secure the rotor to the shaft. Portions 18 and 22 are formed of electrical insulating material and can be formed as a one-piece plastic molding from, for example, a polyester plastic molding material.

Figure 2:
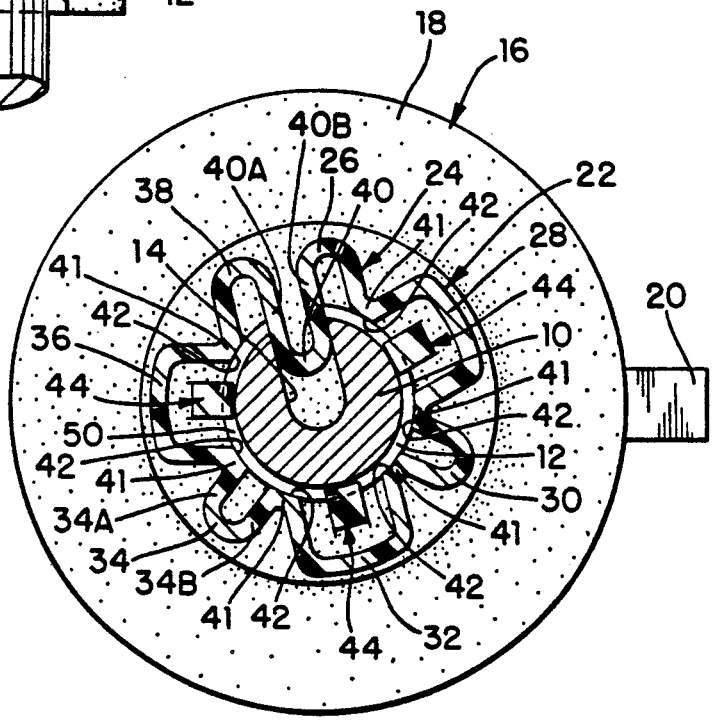
FIG. 2 is a sectional view taken along line 2—2 of FIG. 1.

The rotor portion 22 has a continuous axially extending wall designated in its entirety as 24 that extends from portion 18 of the rotor. This wall, as can be seen in FIG. 2, has an undulated or wave-like shape. The wall 24 has undulations 28, 30, 32, 34, 36, 38 and 40 that are U-shaped. The wall 24 further has six circumferentially spaced wall portions each designated as 41. The wall portions 41 connect the undulated wall portions. Each wall portion 41 has an internal arcuate surface 42. The surfaces 42 are in tight engagement with outer arcuate surface portions of the outer cylindrical surface of shaft 10.

The rotor has three circumferentially spaced, flexible and resilient latch arms each designated as 44. The latch arms 44 are integral with the portion 18 of the rotor and extend axially therefrom. Each latch arm 44 has a tooth portion 46 that is provided with a surface 48 that engages an annular shoulder or surface 50 that defines the top end of groove 12. When the rotor is pushed onto the shaft, the latch arms 44 extend respectively through undulated portions 28, 32 and 36.

It can be seen from FIG. 2 that the undulated portion 40 of wall 24 is located in slot 14. Certain outer surface portions of undulated portion 40 tightly engage inner surfaces portions defining slot 14. The undulated portion 40 can be characterized as a rib that prevents rotation of the rotor relative to the shaft and which forms a driving connection between the shaft and the rotor.

The rotor has an internal surface 52 that engages the flat end surface 54 of shaft 10 when the rotor is assembled to the end of shaft 10. The surface 52 can be provided on a radially extending rib.

The manner in which the rotor 16 is assembled to the end of shaft 10 will now be described. To assemble the rotor to the shaft the undulated portion or rib 40 is aligned with the slot 14 in shaft 10 and the rotor is then pressed onto the shaft. The undulation or rib 40 has a press-fit with the internal walls of slot 14 so that the walls of undulation 40 tightly engage the walls of slot 14.

The outer diameter of shaft 10 is slightly larger than the distance between opposed surfaces 42 on wall 24. Consequently, as the rotor is pressed onto the shaft, portions of wall 24 are deflected or displaced radially outwardly. More specifically, as the rotor is pressed onto the shaft, side wall portions of the undulated portions are deflected away from each other. Using undulated portion 34 as an example of what has just been stated, the side wall portions 34A and 34B will be deflected or moved away from each other as the rotor is pressed onto the shaft. As a result of this, the side walls of the undulated portions tend to develop a spring-like force which tends to force the surfaces 42 into tight engagement with outer surface portions of shaft 10. Further, outer surface portions of side walls 40A and 40B of undulated portion 40 are forced into tight engagement with wall surfaces of slot 14. The spring characteristic of wall 24 therefore causes surfaces 42 to tightly engage outer surface portions of shaft 10. This prevents cocking of the rotor relative to the shaft.

As the rotor is pressed onto the shaft, the three flexible latch arms 44 deflect outwardly and the rib or undulated portion 40 tightens against the walls of slot 14. When the surface 52 on the rotor engages the end surface 54 of shaft 10, the latch arms 44 move inwardly due to their resilience causing teeth 46 to enter groove 12 with the tooth surfaces 48 tightly engaging shoulder or surface 50. The latch arms 44 in the latched position prevent the rotor from moving axially relative to shaft 10. Further, the rotor cannot rotate relative to the shaft because of the tight fit between undulation or rib 40 and the walls of slot 14.

Figure 3:
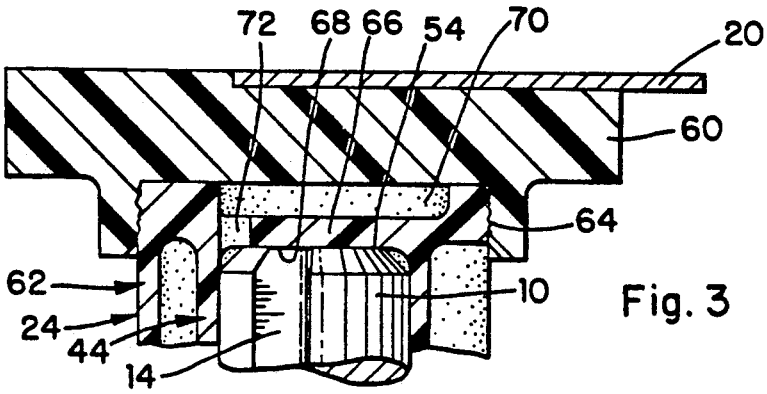
FIG. 3 is a sectional view of a modified distributor rotor shown connected to a distributor drive shaft.

Referring now to FIG. 3, a modified rotor is illustrated that is formed of two plastic parts that are ultrasonically welded together. In FIG. 3, the same reference numerals have been used as were used in FIG. 1 to identify corresponding parts.

In FIG. 3, a plastic part 60 is provided that carries the rotor contact 20. The part 60 is a plastic molded part that can be formed by using a mica-glass filled polyester material that has adequate dielectric properties.

The part 60 is secured to a molded retainer part 62 by an ultrasonic annular weld joint 64. The part 62 is formed of a non-glass filled plastic polyester material to maintain flexibility for the latches 44 and wall 24. In this regard, it should be pointed out that the part 62 shown in FIG. 3 does have latches 44 and a wall 24 which are identical to the latches 44 and wall 24 shown in FIGS. 1 and 2. Because of this, only a portion of the latches 44 and wall 24 have been shown in FIG. 3. Further, in regard to FIG. 3, it is to be understood that shaft 10 has a groove, like annular groove 12.

The part 62 has a wall 66. A lower surface 68 of the wall 66 engages the end surface 54 of shaft 10. An air space 70 is defined by surfaces on parts 60 and 62. This air space 70 is connected to atmosphere via one or more ports 72.

In the rotor of FIG. 3, the part 60 which carries rotor contact 20 has a higher dielectric strength than the part 62. On the other hand, the material of part 62 is more flexible than the material of part 60. Further, both parts have the same polyester base so they therefore can be ultrasonically welded to form the weld joint 64.

The embodiments of the invention in which an exclusive property or privilege is claimed are defined as follows:

1. An ignition distributor rotor and rotor drive shaft comprising in combination, a drive shaft, said drive shaft having an axially and radially extending slot, a rotor formed of electrical insulating material, said rotor having an axially extending wall that has an undulated shape which is defined by circumferentially spaced undulated portions, said wall having a plurality of circumferentially spaced arcuate inner surfaces that tightly engage outer surface portions of said shaft, at least some of inner surfaces being located between certain of said undulated portions, a rib means on said rotor located in said slot to form a driving connection between said rotor and said shaft and means for preventing said rotor from moving axially with respect to said shaft, said last named means comprising at a least one flexible latch arm that is carried by and is integral with said rotor, said latch arm having a surface that is engaged with a shoulder on said shaft.

2. The ignition distributor rotor and rotor drive shaft according to claim 1 where said rib means is one of said undulated portions.

3. The ignition distributor rotor and rotor drive shaft according to claim 1 where said undulated portions are U-shaped.

4. An ignition distributor rotor and rotor drive shaft comprising in combination, a drive shaft, said drive shaft having an axially and radially extending slot and an annular groove, a rotor formed of electrical insulating material, said rotor having an axially extending wall that has an undulated shape which is defined by circumferentially space undulated portions, said wall having a plurality of circumferentially spaced arcuate inner surfaces that tightly engage outer surface portions of said shaft, at least some of said inner surfaces located between certain of said undulated portions, one of said undulated portions located in said slot to form a driving connection between said rotor and said shaft, a plurality of circumferentially spaced flexible latch arms carried by and integral with said rotor, each latch arm having a surface that engages a surface of said annular groove to prevent said rotor from moving axially with respect to said shaft.

5. The ignition distributor rotor and rotor drive shaft according to claim 4 where said undulated portions are U-shaped.

6. A rotor for an ignition distributor comprising, a rotor contact supporting portion, a retainer portion extending axially from said rotor contact supporting portion that is adapted to be pressed onto the end of a distributor shaft, said rotor contact supporting portion and said retainer portion formed of electrical insulating material, said retainer portion having an axially extending wall that has an undulated shape and which is defined by a plurality of circumferentially spaced undulated portions, said retainer portion having a plurality of circumferentially spaced and axially extending flexible latch arms, the ends of said latch arms adapted to move into an annular groove on a distributor shape when said rotor is pressed onto said distributor shaft.

7. The rotor according to claim 6 where said undulated portions are U-shaped.

8. The rotor according to claim 6 where one of said undulated portions forms a radially extending rib that is adapted to be inserted into a slot on a distributor drive shaft when said rotor is pressed onto said shaft.

9. The rotor according to claim 6 where said rotor contact supporting portion and said retainer portion are two separate parts that are connected together by an ultrasonic weld joint.

* * * * *